United States Patent [19]

Colbert

[11] Patent Number: 4,723,683

[45] Date of Patent: Feb. 9, 1988

[54] POP-IN TAB CONTAINER CLOSURE

[75] Inventor: Matt W. Colbert, Canon City, Colo.

[73] Assignee: Clarence J. Carlson, Thornton, Colo.

[21] Appl. No.: 53,684

[22] Filed: May 26, 1987

[51] Int. Cl.[4] ..... B65D 41/32

[52] U.S. Cl. ..... 220/268

[58] Field of Search ..... 220/266–273

[56] References Cited

U.S. PATENT DOCUMENTS

| | | | |
|---|---|---|---|
| 3,262,611 | 7/1966 | Palmer | 220/268 |
| 3,362,569 | 1/1968 | Geiger | 220/268 |
| 3,779,417 | 12/1973 | Klein | 220/268 |
| 4,128,186 | 12/1978 | Gane | 220/268 |
| 4,134,517 | 1/1979 | Rhoades | 220/268 |

*Primary Examiner*—George T. Hall

*Attorney, Agent, or Firm*—Fields, Lewis, Pittenger & Rost

[57] ABSTRACT

A pop-in tab container lid for sealed association with a container body is disclosed. The lid includes a closure panel having a severable score line which extends about a portion of the panel and terminates in spaced oppositely disposed extremities to define a depressible tab and a tab hinge portion between the extremities. The tab has a short stiffening rib and a long stiffening rib extending between the hinge portion and a segment of the score line which is diametrically opposite the hinge portion. Each rib has an inner end opposing that of the other rib so that the ribs are arranged end to end along a common line. An outer end of the short rib terminates at the segment of the score line and an outer end of the longer rib terminates at the hinge portion. The inner opposing ends of the ribs define a weaker area such that when either or both ribs are subjected to a pressing force, the weaker area will bend inwardly towards the container's interior and the ribs will move about their respective outer ends to an inwardly disposed bent position. Such bending movement will concentrate the pressing force at the segment of the score line to initiate fracturing of this segment and continued application of the pressing force will completely sever the tab about its score line to provide an opening in the panel. Modifications disclosed have the outer end of the short rib extending beyond the score line and on the score line and another embodiment has two sets of short and long ribs on a single tab.

24 Claims, 10 Drawing Figures

POP-IN TAB CONTAINER CLOSURE

TECHNICAL FIELD

This invention generally relates to easy open closures for containers and more particularly, to a pop-in tab container closure having a novel and improved depressible tab for providing an opening therein.

BACKGROUND OF THE INVENTION

There have been many efforts to develop easily opened containers or easy open containers as they are generally referred to by those familiar with the art. One easy open container developed for use with pressurized liquids such as beer and carbonated beverages employs what is generally referred to as a "pull tab" in which a ring is attached to a severable tab provided in the container's lid. The tab is defined and made severable by a score line provided in the surface of the lid. To open the container, a user lifts or pulls up on the ring which causes the tab to sever from the lid about the score line defining the tab. This tab has been largely replaced by what is referred to today as the "retained tab" primarily due to environmental and safety concerns associated with the pull tab's disposal.

The "retained tab" solved the aforementioned disposal problems since it remains or is retained on the can lid after the can is opened. There are essentially two general types of retained tabs, the first being the push-in or pop-in type and the second being the more commercially successful lever ring type. The lever ring type employs a ring like lever which is attached to a severable tab at the ring-like lever's midsection. The tab is defined and made severable by a score line except for the tab's hinge portion which remains generally unscored and integral with the can lid. To open the can, a user lifts up on one end of the ring-like lever which causes the other end of the lever to press down upon the tab. This action severs the tab about its score line and inwardly displaces the tab into the can's interior about the tab's integral hinge portion. The hinge portion remains integrally connected to the tab after the tab has been severed from the lid and inwardly depressed. As such, the tab is retained on the lid, hence the term "retained tab."

The aforementioned integral hinge concept is also employed to retain the tab on the above mentioned pop-in type container lid. The pop-in tab is similar to the ring-like lever tab but it does not employ a lever to press down upon the tab. Instead, the user presses his finger directly down upon the tab to open the can. This design generally requires that the user apply a relatively significant amount of force against the tab in order to shear at the score line and sever the tab from the lid. Users of the pop-in tab also often cut their fingers on the sharp edge of the lid's opening which becomes exposed as the tab is inwardly depressed into the container.

Another type of retained tab developed is manufactured with the tab severed from the lid except for the tab's integral hinge portion. This tab is also expanded or flattened during manufacturing so as to be overlapped by the can's lid and the tab is sealed to the lid by a sealant applied on the lid's underside. An example of this type of tab is described in U. S. Pat. No. 4,128,186 to Gane. In addition to being severed from and overlapped by the can's lid, the tab disclosed in Gane is provided with primary and secondary sections. The primary and secondary sections are integrally connected by a selectively weakened hinge portion that runs substantially fully across the tab. Sealant also covers the underside of the can's lid to provide a seal between the lid and the respective tab sections. Upon the application of force, the weakened hinge bends or collapses inwardly so as to fracture the sealant having been applied on the lid's underside at the respective ends of the weakened hinge. This fracturing initiates separation of the tab from the lid and also vents excess pressure having built up in the container.

While the overlapped type push-in container lids of Gane and others similar to it undoubtedly work as intended, overlapped configurations are somewhat expensive to manufacture since additional machining steps are required to produce the overlapped configuration and flattened tab. In addition, the overlap creates a dirt collecting sharp cornered recess which is difficult to clean before opening. Moreover, such containers tend to leak since in the absence of pressure provided by the can's contents only the adhesiveness of the sealant holds the tab up against the lid.

SUMMARY OF THE INVENTION

The container closure disclosed has a depressible tab which is capable of being severed from a lid panel and depressed into a container about a hinge portion of the tab with minimal finger pressure. The container closure includes a closure panel, preferably of sheet metal, having a severable score line thereon which terminates in oppositely disposed extremities to define a depressible tab and a hinge portion between the extremities. The hinge portion enables the tab to be inwardly displaced by pivotal movement about the hinge portion after the tab has been severed from its score line. The tab has strengthening means provided by a short stiffening rib and a long stiffening rib extending between the hinge portion and a segment of the score line opposite the hinge portion. The strengthening means has a first end at the segment of the score line, a second end at the hinge portion and a weaker area between the first and second ends. When a pressing force such as by a finger is applied to the strengthening means, the panel will bend at the weaker area and move about the first and second ends to a bent position with respect to the plane of the panel so as to concentrate the force at the score line's segment to initiate fracturing of the score line at the segment. Once fracturing has been initiated, the tab can be severed along the score line and inwardly depressed about the hinge portion with continued application of the force. The inwardly displaced tab thereby provides an opening through which the container's contents may be poured or through which container pressure may be vented. Modifications disclosed have the first end of the strengthening ribs extending beyond the score line and on the score line. Another embodiment disclosed has two sets of ribs arranged side by side.

BRIEF DESCRIPTION OF THE DRAWINGS

The details of this invention will be described in connection with the accompanying drawings, in which.

DETAILED DESCRIPTION

Figure 1:
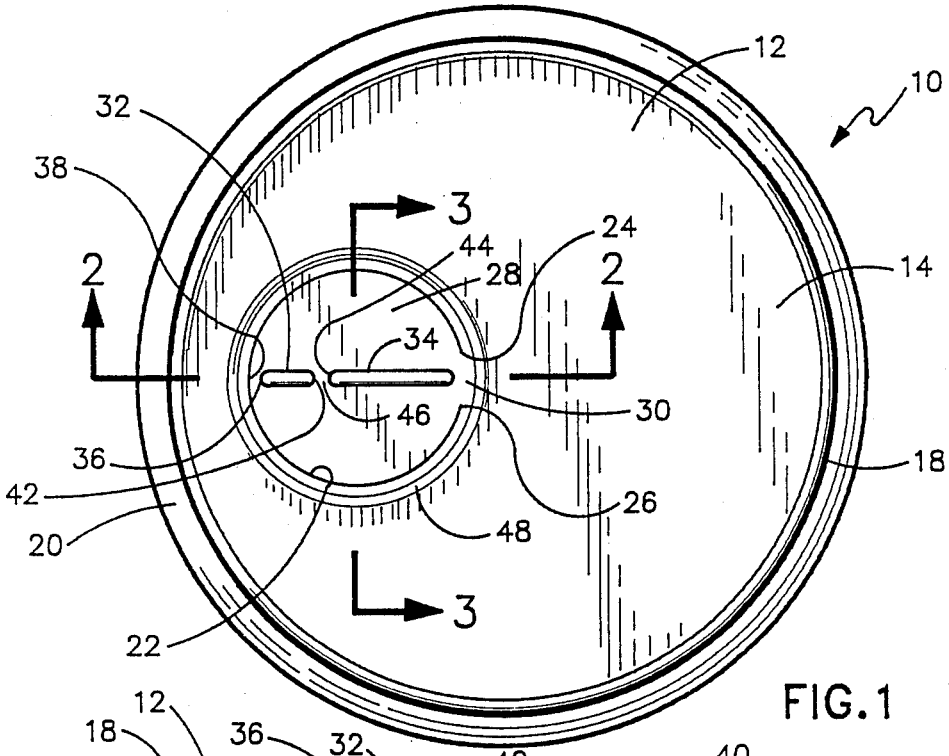
FIG. 1 is a top plan view of a pop-in tab container lid of the present invention shown as sealed to a beverage container.
Figure 2:
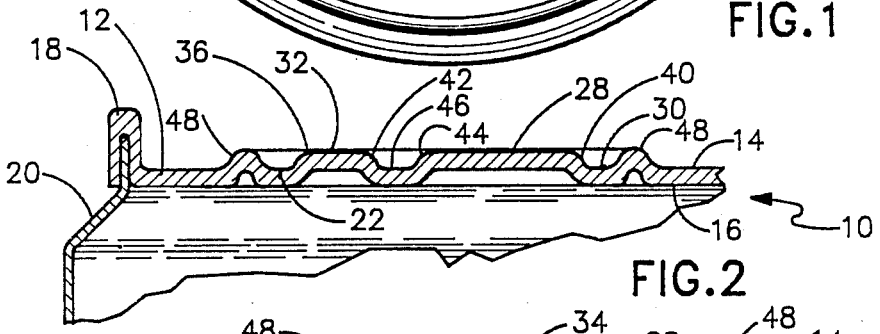
FIG. 2 is a partial cross-sectional view of the lid as taken along line 2—2 of FIG. 1.
Figure 3:
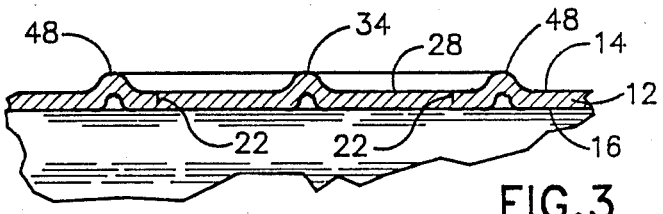
FIG. 3 is a partial cross-sectional view as taken along line 3—3 of FIG. 1.

FIGS. 1 through 6 illustrate a container lid 10 of the present invention. Lid 10 includes a generally flat sheet or panel 12 preferably of sheet metal and preferably aluminum, having an exterior surface 14 and an interior or underside surface 16. Lid 10 as shown is of a circular shape to fit on the end of a cylindrical container and is provided with an outer annular rim 18 constructed and arranged for sealed association with the container's end and, in particular, in sealed association with the top edge portion of a container wall 20 of the container body in a manner that is conventional in the art.

Returning now to FIG. 1, external surface 14 of panel 12 is provided with a score line 22 which extends generally in a circle about a portion of the lid and terminates in spaced oppositely disposed extremities 24 and 26 to define a severable depressible tab 28 and a hinge portion 30 between the extremities. As illustrated, the hinge portion is not scored and, as such, remains an integral non-deformed part of the panel and may also be referred to as virgin material.

One aspect of the present invention is directed to providing tab 28 with strengthening means which in the embodiment of FIGS. 1-6 includes a short stiffening rib 32 and a long stiffening rib 34. These ribs as shown extend above the plane of the exterior of the panels and may be formed therein using conventional techniques such as a punch press or the like. As seen in FIG. 1, short rib 32 terminates at a first outer end 36 at an intermediate portion of the score line identified by numeral 3B and referred to herein as segment 3B of the score line. Segment 3B is diametrically opposite hinge portion 30 of the tab. Long rib 34 terminates at a second outer end 40 adjacent hinge portion 30. As shown the circular tab is offset to one side of the center of the circular panel along a diameter line of the panel 12 with the score line segment 38 being the closest portion of the score line to the outer annular rim portion of the panel. Short and long ribs 32 and 34 also terminate, respectively, at first and second inner ends 42 and 44 which are opposite and adjacent each other so that the ribs are arranged end to end along a line passing between the ribs. Inner ends 42 and 44 define a weaker area 46 of non-deformed virgin material of the panel.

Lid 10 is also provided with an outer circular stiffening rib 48. Rib 48 is formed in the portion of the lid's panel which coextends with score line 22 but rib 48 is spaced slightly outwardly therefrom. Rib 48 also extends beyond the extremities of score line 22 about hinge portion 30.

To open a container having lid 10 of the present invention, a user places a finger on either or both short rib 32 and long rib 34. The user then presses downwardly on the ribs which is inwardly with respect to the container's interior. Such pressing (which is very slight in accordance with the present invention) causes weaker area 46 of tab 2B to bend slightly into the container and ribs 32 and 34 to bend, move or pivot about their respective ends 36 and 40 to the bent position illustrated in FIG. 4. Since end 36 of the short rib is located near segment 38, the pivoting about end 36 concentrates the pressing forces at segment 38. When the forces reach a certain threshold level, referred to herein as the fracture initiating threshold, segment 38 will rupture and thereby initiate fracturing of the score line. Once fracturing of the score line has been initiated, continued application of the pressing forces will cause the score line to sever quickly and easily along its entire length, thereby enabling the tab to be depressed inwardly into the interior of the container about hinge portion 30 to provide the opening 50 illustrated in FIGS. 5 and 6 through which the container's contents may be poured.

Figure 4:
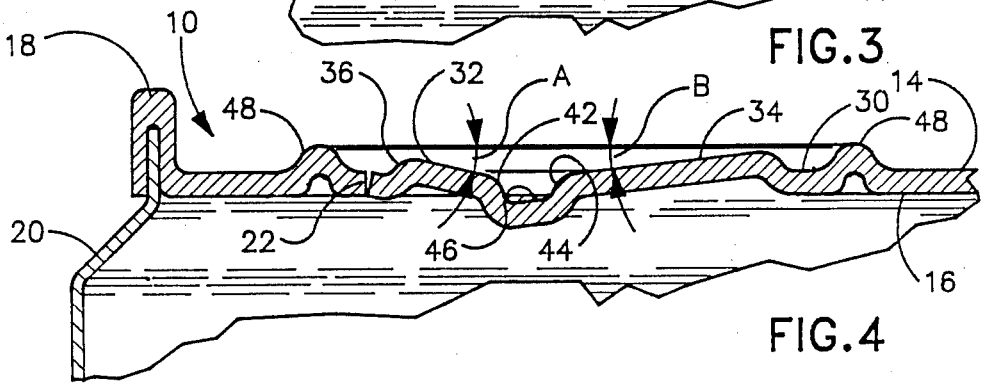
FIG. 4 is a partial cross-sectional view of the lid of FIGS. 1-3 illustrating the lid after its tab has been inwardly depressed to the point where fracturing of the tab's score line has been initiated.
Figure 5:
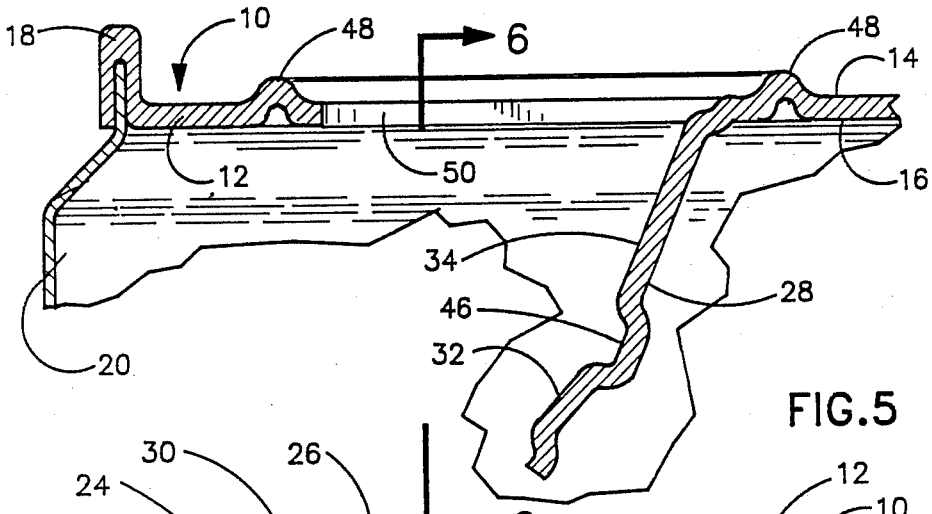
FIG. 5 is a partial cross-sectional view of the lid of FIGS. 1-4 showing the pouring opening provided by depressing the lid's tab inwardly into the container.
Figure 6:
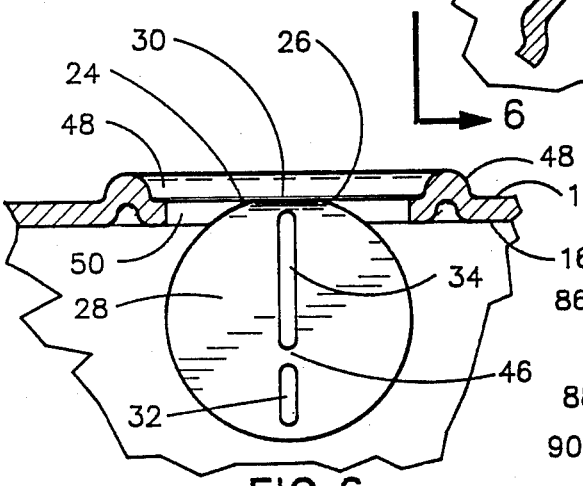
FIG. 6 is a partial cross-sectional view taken along the lines 6—6 of FIG. 5.

Weaker area 46 bends when a finger force is applied to either of the ribs because it is weaker from a relative standpoint than either rib. The ribs' elongated channel-like nature strengthens them structurally, thereby providing them with the capability of withstanding the pressing forces without deforming except, of course, at their outer ends. The ribs act somewhat like a horizontal beam supported at opposite ends with a weaker or weakened area between the supported ends. When a uniform load is applied to such a horizontal beam it will bend at the weakened area and concentrate the load forces at the supported ends causing bending to occur at the supported ends so the portions of the beam on each side of the weaker area will move about or pivot at the respective supported ends to angular positions in relation to the plane of the original horizontal beam. Accordingly, when weaker area 46 bends as illustrated in FIG. 4, ribs 32 and 34 bend, move or pivot about their respective ends 36 and 40. Since ends 36 and 40 are located, respectively, at segment 38 of the score line and hinge portion 30, such bending at ends 36 and 40 concentrates the pressing forces at segment 38 and hinge portion 30. Since segment 38 is scored, it will rupture or fracture very easily when the pressing forces being concentrated in segment 38 reach the aforementioned fracture initiating threshold.

One aspect of the present invention is directed to lowering the fracture initiating threshold at segment 38 since the lowering of such will reduce the amount of finger pressure which is needed to sever the tab and thereby open the lid. It has been found that the fracture threshold can be lowered by predetermining the lengths of the short and long ribs so that the length ratio of the strengthening means which is the combined length of both ribs (including distance across weaker area 46) to the short rib is between about 3 to 1 and 4 to 1. This is because length ratios within this range increase the concentration of forces at segment 38. This can be visualized from the view illustrated in FIG. 4 wherein it can be seen that short rib 32 pivots about its end 36 at segment 38 to a slightly greater angle (i.e. angle A) from the plane of the panel than long rib 34 does in pivoting about its end 40 at hinge portion 30 (i.e. angle B). By pivoting to a greater angle, short rib 32 has pivoted or moved more about its end 36 than long rib 34 has about its end 40. Such increased movement, increases the concentration of stress or forces at segment 38 which, in turn, lowers the fracture threshold of segment 38. In other words, by increasing the amount of bending movement which occurs at segment 38 stress concentration at segment 38 can be increased which, in turn, lowers the fracture threshold, thereby reducing the amount of finger pressure needed to initiate fracturing of the score line. With this in mind, those skilled in the relevant art would logically think that further decreases in the length of short rib 32, would increase pivotal movement about end 36 at segment 38 and thereby increase the concentration of forces or stresses at segment 38. This is true to an extent; however, there is a limit to how short rib 32 can be since the leverage or torque-like forces acting on segment 38 via short rib 32 (which acts much like a moment-arm) will decrease as short rib 3B is shortened. Accordingly, it is believed that a short rib having a length which is so short as to provide a length ratio greater than about 4:1 will probably not provide enough torque on segment 38 to enable a user to fracture the score line at segment 38 with the desired minimal finger pressure. A length ratio which has provided good results is about 3.6 to 1 which is the approximate length ratio of the ribs illustrated in the drawings.

Figure 7:
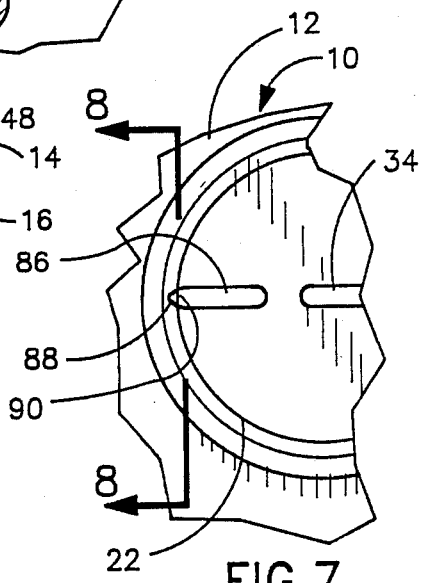
FIG. 7 is a partial top plan view of a modification of the lid having a short stiffening rib extending across the score line.
Figure 8:
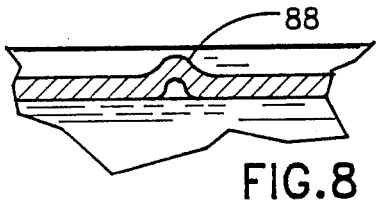
FIG. 8 is a partial cross-sectional view taken along the lines 8—8 of FIG. 7.

FIGS. 7 and 8 illustrate a lid 10 that is modified from the lid shown in FIGS. 1–6 by having the tab provided with a short rib 86 having a tapered end 88 that extends a preselected distance across a narrow segment 90 of score line. Tapered end 88 of short rib 86 provides enhanced concentration of the pressing forces in narrower segment 90 for two reasons. First, unlike short rib 32 above described rib 86 actually extends across the score line 22, thereby insuring that the forces reach and concentrate in segment 90 of the score line. Second, tapered end 88 is quite narrow at the point it crosses the score line. Accordingly, the forces are concentrated in a narrower segment of the score line (i.e. narrow segment 90). Thus, the highly concentrated forces should lower the fracture initiating threshold at segment 90, thereby enabling the score line to be severed very easily (i.e. with minimal finger force).

Figure 9:
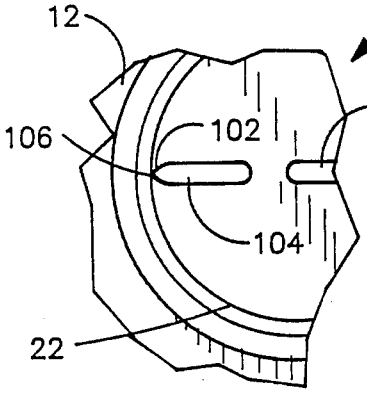
FIG. 9 is a partial top plan view of another modification of the lid having a short stiffening rib which terminates at its outer end on the score line.

FIG. 9 illustrates a modification of the lid 10 to the extent that a tapered end 102 of a short rib 104 terminates directly on a segment 106 of the score line 22. Since short rib 104 is tapered similarly to that of lid 70, the finger pressing forces should also concentrate in a narrow portion of the score line (i.e. segment 106). Moreover, by terminating directly on segment 106, the short rib's end 102 bends directly away from the side of the panel it opposes at segment 106 (i.e. when a finger pressing force is applied to the ribs of lid 100). Accordingly, the fracture initiating threshold should be lowered and users should be able to sever the score line at segment 106 with little effort.

Figure 10:
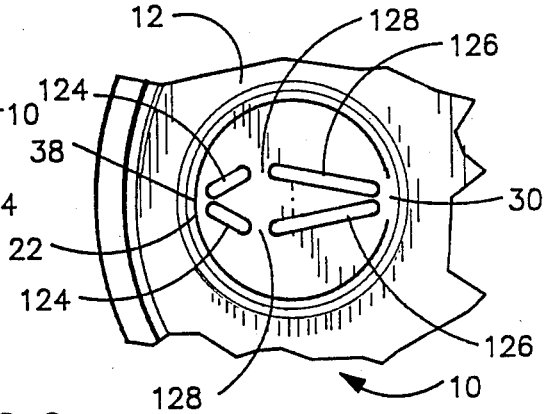
FIG. 10 is a partial top plan view of another embodiment of the lid wherein the tab is provided with two pairs of short and long stiffening ribs disposed side by side.

Referring now to FIG. 10 there is shown a lid 10 with a tab 28 in which the strengthening means has been modified by providing two pairs of ribs (i.e. short ribs 124 and long ribs 126) disposed side by side. More specifically these ribs are arranged symmetrically on opposite sides of a center line through the tab which passes through the hinge portion and the segment. Each pair of ribs 124 and 126 defines a weaker area 128 between its respective rib's opposing ends. Each pair of short and long ribs also defines an equal but oppositely facing included angle, which together define a diamond-like shaped figure. The short ribs 124 converge toward the segment 38 of the score line opposite hinge portion 30 to concentrate the forces at segment 38. The long ribs 126 converge toward hinge portion 30. This configuration of ribs also serves to guide a user in locating his finger or thumb on the ribs above the respective weaker areas 128 and increases the forces applied to sever the score line. A user who positions a finger or thumb as such will be less likely to cut the finger or thumb on the edge of the lid's opening which becomes exposed as the tab is depressed inwardly.

In use, the tab shown in FIG. 10 collapses or bends inwardly much the same as the tab described for FIGS. 1–6 28 with the exception that both weaker areas 128 bend or collapse inwardly and both pairs of converging short ribs 124 and converging long ribs 128 move about their respective ends to concentrate the pressing forces at a segment 38 of the score line to initiate fracturing of the score line. Similarly, once fractured at segment 38, the tab may be severed along its entire score line and then inwardly depressed about the hinge portion with continued application of the finger pressing forces.

Accordingly, those skilled in the relevant art will appreciate that the present invention provides an inexpensive push-in or pop-in container lid having a novel, inwardly depressible tab which is capable of being severed from the lid and inwardly depressed about a hinge portion of the tab with minimal finger pressure. As such, the need for leverage increasing components such as pull rings and/or lever rings is obviated. Accordingly, manufacturing costs and metal usage are reduced which thereby reduces the overall cost of the container lid. Moreover, the ability to open the container with minimal pressure is highly desirable since users will be less likely to cut their fingers on the exposed edge of the lid's opening as they depress the tab.

Although the present invention has been described with a certain degree of particularity, it is understood that the present disclosure has been made by way of example and that changes in details of structure may be made without departing from the spirit thereof.

What is claimed is:

1. A container closure comprising:

a closure panel having a severable score line terminating in spaced oppositely disposed extremities to define a depressible tab and a hinge portion between said extremities, said tab having strengthening means extending between said hinge portion and a segment of said score line opposite said hinge portion, said strengthening means having a first end at said segment of the score line, a second end at said hinge portion, and a weaker area between said first and second ends such that when a force is applied to said strengthening means, said strengthening means will bend at said weaker area and move about its first and second ends to a second position displaced from the plane of the panel so as to concentrate said force at said segment to initiate fracturing of the score line at said segment, thereby enabling the tab to be severed along the score line and inwardly depressed about the hinge portion with the continued application of said force.

2. A container closure as set forth in claim 1 wherein said weaker area is closer to said segment than said hinge portion to provide a shorter strengthening portion in said adjacent said segment and a longer strengthening portion in said tab adjacent said hinge portion.

3. A container closure as set forth in claim 1 wherein the ratio of the length of said shorter strengthening portion to the total length of said strengthening means is between about one to three to one to four.

4. A container closure as set forth in claim 1 wherein said strengthening means is provided by forming a pair of stiffening ribs in said tab.

5. A container closure as set forth in claim 4 wherein the ribs are arranged end to end along a common line with said weaker area being located between the opposing ends of said ribs.

6. A container closure as set forth in claim 5 wherein said tab is circular and said common line extends through the center of a circular tab.

7. A container closure as set forth in claim 1 further including an outer annular rim portion for facilitating said sealed association with a container body.

8. A container closure as set forth in claim 5 wherein said weaker area is closer to said segment than said hinge portion to provide a short stiffening rib and a long stiffening rib.

9. A container closure as set forth in claim 8 wherein after moving to said second position said short stiffening rib will have moved about said first end at said segment of the score line to a greater angle with respect to the plane of the panel than that to which said long stiffening rib has moved about said second end at said hinge portion.

10. A container closure as set forth in claim 4 wherein said strengthening means is provided by two sets of long and short stiffening ribs with said ribs disposed side by side and said short ribs disposed side by side on opposite sides of the center of the tab.

11. A container closure as set forth in claim 10 wherein said short ribs converge toward said segment to concentrate forces therein.

12. A container closure as set forth in claim 4 wherein the ribs are formed in said panel above the plane of the exterior of said panel.

13. A container closure as set forth in claim 1 wherein said strengthening means extends a preselected distance across said segment of the score line.

14. A container closure as set forth in claim 13 wherein said strengthening means is provided by a short stiffening rib and a long stiffening rib with said first end being on said short stiffening rib, said first end of said short stiffening rib being tapered to concentrate said force in a narrower segment of said segment of said score line.

15. A container closure as set forth in claim 1 wherein said first end of said stiffening means terminates on said segment of said score line.

16. A container closure as set forth in claim 15 wherein said strengthening means is provided by a short stiffening rib and a long stiffening rib with said first end being on said short stiffening rib, said first end of said short stiffening rib being tapered.

17. A container closure as set forth in claim 1 further including an outer stiffening rib formed in the panel, said stiffening rib coextending with said score line about said tab but being spaced a selected distance outwardly therefrom.

18. A container closure as set forth in claim 17 wherein the outer stiffening rib extends about said tab and said hinge portion.

19. A container closure as set forth in claim 1 wherein said strengthening means pivots about its first and second ends when subjected to a further pressing force.

20. A container closure as set forth in claim 1 wherein said strengthening means bends about its first and second end when subjected to a finger pressing force.

21. A container closure as set forth in claim 1 wherein said panel is sheet metal.

22. A pop-in tab container lid for sealed association with a container body to provide a sealed container, said lid comprising:

a generally flat, circular panel having an interior and exterior surface, an outer annular rim portion for sealed association with the container body and a severable score line, said score line extending generally circumferentially on the panel's exterior surface and terminating in spaced oppositely disposed extremities to define a depressible tab and a hinge portion between said extremities, said panel also having an outer circular stiffening rib formed in the panel which coextends with the score line about the tab but is spaced a selected distance outwardly therefrom, said tab being inwardly displaceable into the container's interior by pivotal movement about said hinge portion after said score line has been severed, said inwardly displaced tab thereby providing an opening for the container through which container pressure may be vented or through which the container's contents may be poured, said tab having a shorter and a longer elongated stiffening rib, said shorter rib terminating at a first outer end at a segment of said score line which diametrically opposes said hinge portion, said longer rib terminating at a second outer end at said hinge portion, said shorter and longer ribs also terminating, respectively, at first and second inner ends which oppose each other so that the ribs are arranged end to end along a common line, the area between said inner opposing ends defining a weaker area which is such that when a finger pressing force is applied to the shorter and/or longer ribs, said weaker area will bend inwardly towards the container's interior and said ribs will move about their respective first and second outer ends to an inwardly disposed bent position with respect to the plane of the panel so as to concentrate the force at said segment of the score line to initiate fracturing of the score line at said segment, thereby enabling the tab to be severed along the score line and inwardly depressed about the hinge portion with the continued application of said finger force.

23. A pop-in tab container lid as set forth in claim 22 wherein said tab is offset to one side of the center of said panel along a diametrical line of said panel with said segment being the closest portion of the score line to the outer annular rim portion of said panel.

24. A pop-in tab container lid as set forth in claim 22 wherein said tab is circular and said stiffening means extends along a diametrical line of said circular tab for almost the full extent of the diameter of said circular tab.

* * * * *